United States Patent [19]

Cormier

[11] 4,429,754

[45] Feb. 7, 1984

[54] METHOD AND APPARATUS FOR CLEARING EARTH DRILL CUTTINGS FROM AROUND DRILL HOLES

[76] Inventor: Leo P. Cormier, P.O. Box 217, Hanna, Wyo. 82327

[21] Appl. No.: 283,433

[22] Filed: Jul. 15, 1981

[51] Int. Cl.[3] ..... E21B 12/06

[52] U.S. Cl. ..... 175/88; 175/161; 175/209; 175/84

[58] Field of Search ..... 198/311, 671, 518; 175/84, 88, 161, 209, 210, 211, 220

[56] References Cited

U.S. PATENT DOCUMENTS

| | | | |
|---|---|---|---|
| 2,107,552 | 2/1938 | Smith | 175/209 |
| 2,834,451 | 5/1958 | Turner | 198/311 |
| 3,088,718 | 5/1963 | Lilly | 198/518 |
| 3,190,375 | 6/1965 | Pearson | 175/88 |
| 3,747,697 | 7/1973 | Russell, Jr. | 175/88 |
| 3,791,464 | 2/1974 | Stewart | 175/88 |
| 4,295,534 | 10/1981 | Zachmeier | 175/88 |

*Primary Examiner*—Stephen J. Novosad

*Assistant Examiner*—William P. Neuder

*Attorney, Agent, or Firm*—Mallinckrodt, Mallinckrodt, Russell & Osburn

[57] ABSTRACT

Means are provided in combination with the depending cylindrical skirt of a drill rig for conveying drill cuttings from around the drill stem during a drilling operation so they will not deposit in the usual annular pile around the open mouth of the drill hole. The means comprise a hopper attached to the lower end of the skirt and having a side discharge opening into which one end of an endless conveyor protrudes in confronting relationship with the drill stem that passes through an accommodating opening in the otherwise closed bottom of the hopper. The conveyor is advantageously of scraper type, having an endless chain with scraper blades at intervals along its length that scrape along the bottom of a conveyor trough, and advantageously having an elongate discharge opening extending lengthwise of the bottom of the trough adjacent to the discharge end of the conveyor.

3 Claims, 3 Drawing Figures

METHOD AND APPARATUS FOR CLEARING EARTH DRILL CUTTINGS FROM AROUND DRILL HOLES

BACKGROUND OF THE INVENTION

1. Field

The invention has to do with drilling rigs and with the removal of drill cuttings from around the open entrances of drill holes in the earth during drilling, so as to keep the margins of the drill hole openings free and clear of the usual build-up of cuttings.

2. State of the Art

It is customary in the art of drilling blast holes in the earth to permit the drill cuttings to lie where they fall about the open entrances to the holes being drilled, so they build up into cumbersome, annular piles surrounding the hole openings. This is aggravated by the fact that a flexible skirt ordinarily depends from attachment to the underside of the deck of a blast hole drilling rig and surrounds the drill steel, i.e. drill stem, during a drilling operation. Such build-up of cuttings makes hole access difficult for whatever reasons access is desired during the drilling operation and is inefficient, since cuttings inevitably fall back into the hole to an extent which deprives the blast of a significant amount of its intended effect.

SUMMARY OF THE INVENTION

In accordance with the invention, an elongate conveyor is combined with the usual flexible skirt of the customary blast hole drilling rig, so that the drill cuttings are deposited in a hopper, which is attached to the lower end of the skirt as part of the invention, and are fed into one end of the conveyor. The conveyor is advantageously of scraper type, with one end reaching into the hopper and its length extending outwardly therefrom a distance sufficient to deposit the drill cuttings at a dump site suitably remote from the drill hole. Feeding of the drill cuttings into the conveyor is facilitated by the pressure air customarily used in the drilling operation to bring such cuttings to the surface. Discharge of the conveyed drill cuttings is advantageously through an elongate opening provided in the bottom of the conveyor trough along which the endless, scraper-provided chain extends.

THE DRAWINGS

An embodiment of the invention, representing the best mode of carrying it out in practice, is illustrated in the accompanying drawings in which;

FIG. 1 is a fragmentary side elevational view of a typical blast hole drilling rig in drilling position showing deck, skirt, hopper, and conveyor of the invention;

FIG. 2, a horizontal section taken on the line 2—2 of FIG. 1, and drawn to a larger scale, the conveyor top plate having been removed for convenience of illustration;

FIG. 3, a longitudinal vertical section taken on the line 3—3 of FIG. 2.

DETAILED DESCRIPTION OF ILLUSTRATED EMBODIMENT

Figure 1:
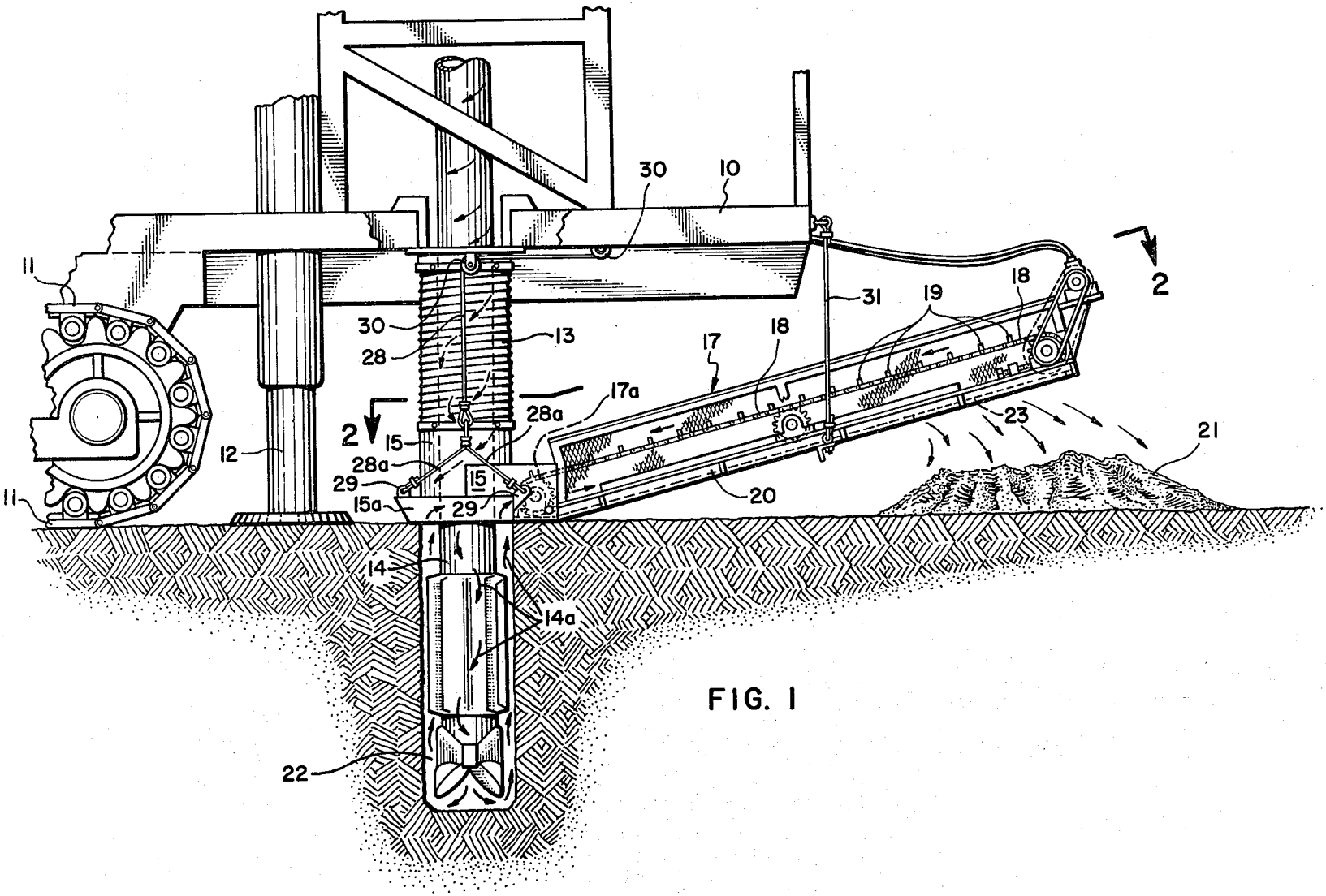

A conventional rig for drilling blast holes comprises a drill deck 10 carried by cleated, endless tracks 11, so as to be mobile for movement from one drilling location to another. Retractable legs 12 provide for stabilizing the rig for drilling operations.

A flexible, cylindrical skirt 13 of accordian construction, so as to be collapsible from drilling position for transport purposes, is attached to the underside of drill deck 10 in conventional manner and ordinarily would depend therefrom with its lower end free for resting on the surface of the earth during a drilling operation, the drill stem 14 extending therethrough in spaced relationship therewith during a drilling operation.

In accordance with the invention, however, the lower end of skirt 13 is extended downwardly by attachment, in this illustrated embodiment to the upper end of a hopper 15, whose preferably tray-like bottom 15*a* is provided with an opening 16 through which drill stem 14 extends for drilling purposes.

Skirt 13 is normally air tight, and it is advantageous that the ends thereof connect with drill deck 10 and with hopper 15 (hopper bottom 15*a* as here shown), respectively, in substantially an air-tight manner to largely confine pressure air, 14*a*, commonly used in the drilling operation to bring drill cuttings to the surface.

One side of hopper 15 is open, advantageously at the end of a lateral as at 15*b*, for receiving one end of an elongate, endless conveyor 17 so as to remove drill cuttings as they are deposited within the hopper a drilling operation. Since the drill cuttings are deposited on the bottom 15*a* of the hopper, it is advantageous that the conveyor be of scraper type having an endless chain 18, equipped at intervals along its length with scraper blades 19, and operating within an elongate trough 20. The blades 19 scrape along the bottom 20*a* of trough 20, pushing drill cuttings from feed end to discharge end of the conveyor.

The feed end 17*a* of conveyor 17 extends within hopper 15 through opening 15*b* thereof and rests on hopper bottom 15*a*, confronting drill stem 14 so as to be in a position to receive drill cuttings as they are carried into such conveyor end 17*a* by the pressure air 14*a* escaping through hopper opening 15*b*.

The length of conveyor 17 extends from hopper 15 exteriorly thereof to a dump site 21 suitably remote from the drill hole 22 to effectively eliminate the usual dropping of cuttings back into the hole when the drill is withdrawn and particularly when the drill rig is moved so as to drag the skirt across the drill hole, as is often the case with conventional drill rigs.

Figure 2:
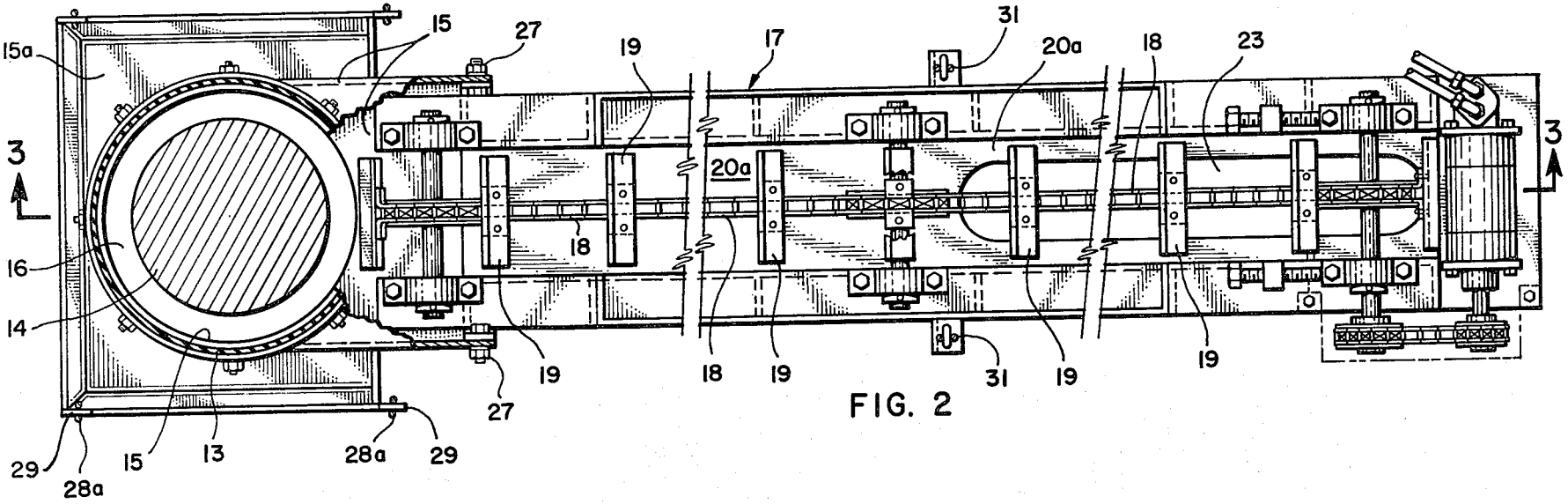

It is advantageous to provide an elongate discharge opening 23 lengthwise along trough bottom 20*a* adjacent to the far end of the conveyor, so as to facilitate discharge and piling of the discharged cuttings, and to enclose the conveyor laterally by heavy screening 25 and on top by a plate covering 26, both of which desirably extend from end to end of the conveyor. The feed end of the conveyor is pivotally mounted, as at 27, FIG. 2, to permit it being raised and lowered as required.

Figure 3:
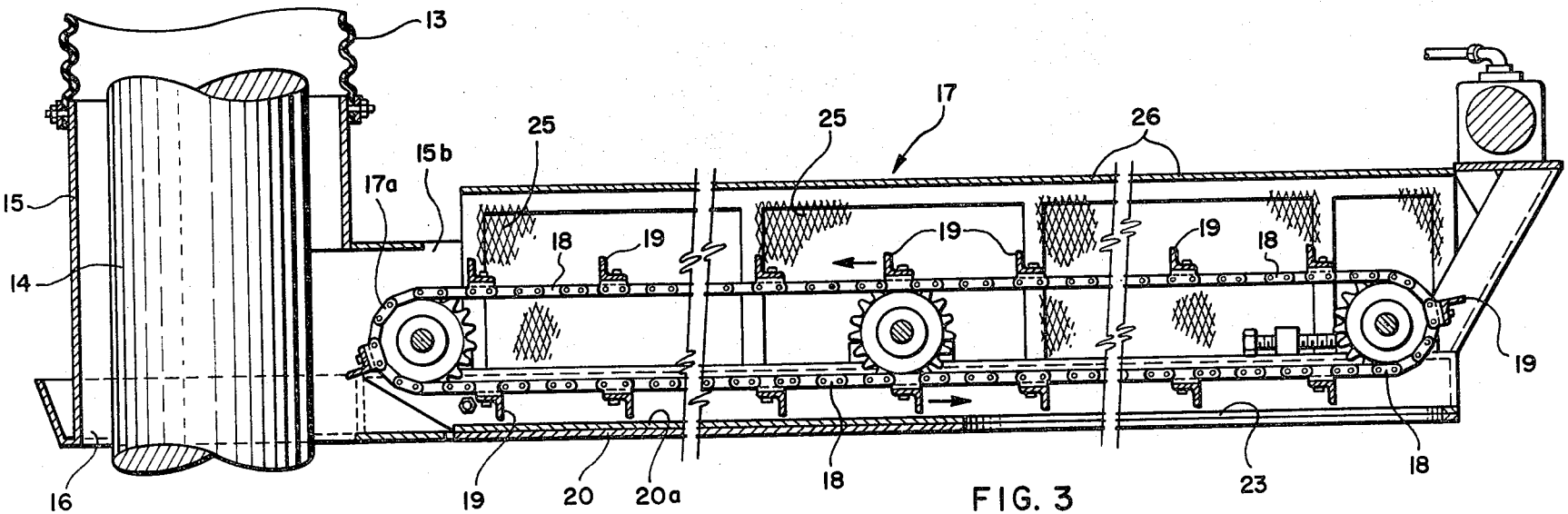

Hopper 15 and the corresponding end of conveyor 17 are supported by cables 28, FIG. 1, attached to respective bails 28*a* at opposite sides of skirt 13, respectively, which are looped through respective sets of eyes 29 at opposite sides of the hopper, are passed over respective sets of pulleys 30 at the underside of deck 10, and are connected to a lift (not shown) whereby hopper and conveyor end can be lifted for rig transport, see FIG. 3, the skirt 13 collapsing in customary manner as hopper and conveyor end are lifted.

The extended length of conveyor 17 is supported by a sling 31 depending from attachment to the drill deck intermediate the length of the conveyor.

It has been found that the invention effectively prevents the usual accidental backfilling of the drilled holes. For example, in a typical drill area, for every linear foot of drilled hole twelve and a quarter inches in diameter, there are 1680 cubic inches of cuttings (including the swell factor). For every foot of drilled hole accidentally backfilled on a 33 ft.×33 ft. drill pattern, 40.33 cubic yards of material is lost to fracturing when an explosive in the drill hole is detonated. It has been found that as much as fifty feet of a two hundred feet deep drill hole has been lost by accidental backfilling in the usual blast drilling operation. This is prevented by the invention.

Whereas this invention is here illustrated and described with specific reference to an embodiment thereof presently contemplated as the best mode of carrying out the invention in actual practice, it is to be understood that various changes may be made in adapting the invention to different embodiments without departing from the broader inventive concepts disclosed herein and comprehended by the claims that follow.

I claim:

1. Apparatus for clearing a drill hole opening of cutting deposited about the margin of the opening by the drill during an earth drilling operation, comprising, in combination with a drilling rig having a deck through which the drill stem extends during the drilling operation and a skirt attached to the underside of said deck and adapted to surround the drill stem in spaced relationship therewith during a drilling operation, a hopper positioned below the skirt and having the lower end of the skirt attached thereto; and an elongate endless conveyor having one end positioned within said hopper and the length thereof extending exteriorly of the hopper to a dump site remote from the drill hole opening, whereby drill cuttings which tend to be deposited within the hopper about the drill stem are removed by the conveyor, said conveyor being of scraper type having an endless chain equipped with scraper blades and operating in a trough so that the scraper blades scrap drill cuttings along the bottom of the trough, the bottom of the trough having an elongate discharge opening extending therein and along the length thereof adjacent to the other end of the conveyor.

2. Apparatus for clearing a drill hole opening of cuttings deposited about the margin of the opening by the drill during an earth drilling operation, comprising, in combination with a drilling rig having a deck through which the drill stem extends during the drilling operation and a skirt attached to the underside of said deck and adapted to surround the drill stem in spaced relationship therewith during a drilling operation, a hopper positioned below the skirt and having the lower end of the skirt attached thereto; an elongate endless conveyor having one end positioned within said hopper and the length thereof extending exteriorly of the hopper to a dump site remote from the drill hole opening, whereby drill cuttings which tend to be deposited within the hopper about the drill stem are removed by the conveyor; and means for raising and lowering the hopper and corresponding end of the conveyor for rig transport purposes.

3. Apparatus in accordance with claim 2, wherein there is also provided a sling depending from attachment to the drill deck and supporting the conveyor intermediate its length.

* * * * *